US011697480B2

(12) United States Patent
Fränkel et al.

(10) Patent No.: US 11,697,480 B2
(45) Date of Patent: Jul. 11, 2023

(54) PROPELLER ARRANGEMENT

(71) Applicants: Andrés Fränkel, Perchtoldsdorf (AT); Benjamin Fränkel, Perchtoldsdorf (AT); Constantin Fränkel, Perchtoldsdorf (AT)

(72) Inventors: Andrés Fränkel, Perchtoldsdorf (AT); Benjamin Fränkel, Perchtoldsdorf (AT); Constantin Fränkel, Perchtoldsdorf (AT)

( * ) Notice: Subject to any disclaimer, the term of this patent is extended or adjusted under 35 U.S.C. 154(b) by 0 days.

(21) Appl. No.: 17/952,662

(22) Filed: Sep. 26, 2022

(65) Prior Publication Data

US 2023/0111172 A1 Apr. 13, 2023

(30) Foreign Application Priority Data

Sep. 27, 2021 (AT) ..... 50763/2021

(51) Int. Cl.
*B63H 1/20* (2006.01)
*B63H 23/34* (2006.01)
*E04H 4/16* (2006.01)

(52) U.S. Cl.
CPC ..... *B63H 1/20* (2013.01); *B63H 23/34* (2013.01); *E04H 4/1654* (2013.01); *B63H 2023/342* (2013.01)

(58) Field of Classification Search
CPC ..... B64C 27/32; B64C 11/04; B64C 39/024; B64C 2700/6283; B64C 2201/108; B64C 2201/165; B64C 2201/024; B64U 30/20; B64U 10/10; B64U 50/13; Y02T 70/54
See application file for complete search history.

(56) References Cited

U.S. PATENT DOCUMENTS

2016/0200418 A1* 7/2016 Wang ..... B64C 11/02 416/204 R
2019/0248471 A1 8/2019 Jiang et al.

FOREIGN PATENT DOCUMENTS

DE 202018107417 U1 4/2019
KR 101859162 B1 * 5/2018 ..... B64C 11/04
KR 101859162 B1 5/2018
WO 2021017004 A1 2/2021

OTHER PUBLICATIONS

English Translation KR 101859162 B1 (Year: 2018).*

* cited by examiner

*Primary Examiner* — Shafiq Mian
(74) *Attorney, Agent, or Firm* — Dykema Gossett PLLC

(57) ABSTRACT

The invention relates to a propeller arrangement (1) having a propeller part (2) and a shaft part (3), in particular for an underwater vacuum cleaner, wherein the propeller part (2) and the shaft part (3) are coaxially connected to one another via a latching connection (4), which latching connection (4) has at least two latching fingers (5) which can move elastically in a latching direction (R) radially with respect to an axis of rotation (1*a*) of the propeller arrangement (1), and a latching opening (6) for accommodating the latching fingers (5).

The latching fingers (5) are formed integrally with the shaft part (3). The latching fingers (5) and the latching opening (6) form—in and/or against a direction of rotation (P) of the propeller arrangement (1) —a positive connection. This enables an easily detachable rotary connection between the propeller part (2) and the shaft part (3) in a simple manner.

13 Claims, 6 Drawing Sheets

PROPELLER ARRANGEMENT

CROSS-REFERENCE TO RELATED APPLICATION

This application claims the benefit of priority to Austria application No. A 50763/2021, filed 27 Sep. 2021.

BRIEF SUMMARY

The invention relates to a propeller arrangement having a propeller part and a shaft part, in particular for an underwater vacuum cleaner, wherein the propeller part and the shaft part are coaxially connected or connectable to one another via a latching connection, which latching connection has at least two latching fingers, which can be moved elastically in a latching direction radially with respect to the axis of rotation of the propeller arrangement, and a latching opening for accommodating the latching fingers.

BACKGROUND

In the case of propeller arrangements for applications in water, for example for underwater vacuum cleaners for swimming pools, there is a risk of malfunctions due to threads, hair, plant parts or the like looping around the rotary shaft, which in the worst case can only be removed from the rotary shaft by relatively time-consuming and labor-intensive disassembly of the propeller.

A propeller arrangement is known from KR 101859162 B1, wherein a propeller part is connected to a shaft part via a latching connection. The latching connection has latching fingers which are spaced apart from one another, are arranged essentially parallel to one another in the installed position and are screwed to a rotary shaft via a fixing part. The latching fingers are arranged in an axial recess of one end of the rotary shaft, with latching hooks arranged at the ends projecting from the recess. The latching fingers are pretensioned radially outward by a separate compression spring. In the assembled state, the end of the rotary shaft is inserted in a hub of the propeller, with the latching fingers penetrating the hub and the radially outwardly pressed latching hooks engaging the end face remote from the rotary shaft and holding the propeller axially on the rotary shaft. To transmit the torque, a torque transmission unit is provided which has a sleeve arranged between the hub and the rotary shaft and connected to the propeller in a rotationally fixed manner, which sleeve has arcuate concave form-fit areas which interact with corresponding arcuate convex form-fit areas of the rotary shaft so that torque can be transmitted between the rotary shaft and the sleeve. This arrangement has many individual parts, which has a detrimental effect on manufacturing and assembly effort, durability, and size.

SUMMARY OF THE INVENTION

It is the object of the invention to enable an easily detachable rotary connection between the propeller part and the shaft part in the simplest possible way.

According to the invention, this object is solved in that the latching fingers are formed integrally with the shaft part and that the latching fingers and the latching opening—in and/or against a direction of rotation—form a positive connection.

The positive connection is advantageously defined by the cross-section of the latching opening and the profile of the latching fingers. The profile of the latching fingers and the cross-section of the latching opening are matched to each other in such a way that a positive connection in and/or against the direction of rotation and thus a torque transmission between the propeller part and the shaft part is made possible. For example, the latching opening has a rectangular cross section.

Advantageously, it is provided that the latching fingers are provided to rest directly against at least one first flank and/or at least one second flank of the latching opening. A further element between the latching finger and the latching opening is not required for torque transmission. The number of parts can thus be kept to a minimum.

In order to enable easy mounting and removal of the propeller part on or from the latching fingers, it is advantageous if at least one first flank and/or at least one second flank of the latching opening has at least one depression and/or at least one guide strip. As a result, the contact area between the latching fingers and the latching opening can be reduced and the friction during mounting or dismounting can be reduced. The reduced force required reduces the risk of damage to the propeller arrangement during assembly or disassembly.

In one embodiment variant of the invention, it is provided that the latching opening has a width measured perpendicular to the latching direction between two parallel first flanks, which corresponds at least to the finger width of the latching fingers. It is advantageous if the latching opening has a width measured in the latching direction between two parallel second flanks, which corresponds at least to the minimum outer distance between the latching fingers. This enables sufficiently large torque transmission.

Within the scope of the invention, it is provided that the shaft part is designed as a shaft cap which can be connected or is connected in a rotationally fixed manner to a rotary shaft of a drive motor. The shaft cap can, for example, be permanently connected to the rotary shaft, in particular pressed and/or glued or screwed.

In a further embodiment of the invention, it is provided that the propeller part and/or the shaft part consist(s) of a thermoplastic terpolymer, preferably an acrylonitrile-butadiene-styrene copolymer. The use of acrylonitrile-butadiene-styrene copolymer for the propeller part and shaft part has, for example, the advantage of high resistance to weathering and aging, high elasticity and stability.

As a result, a large number of assembly and disassembly operations can be achieved between the propeller part and the shaft part, and a long service life can be made possible.

The invention is explained in more detail below with reference to the non-limiting figures, wherein:

DETAILED DESCRIPTION

Figure 1:
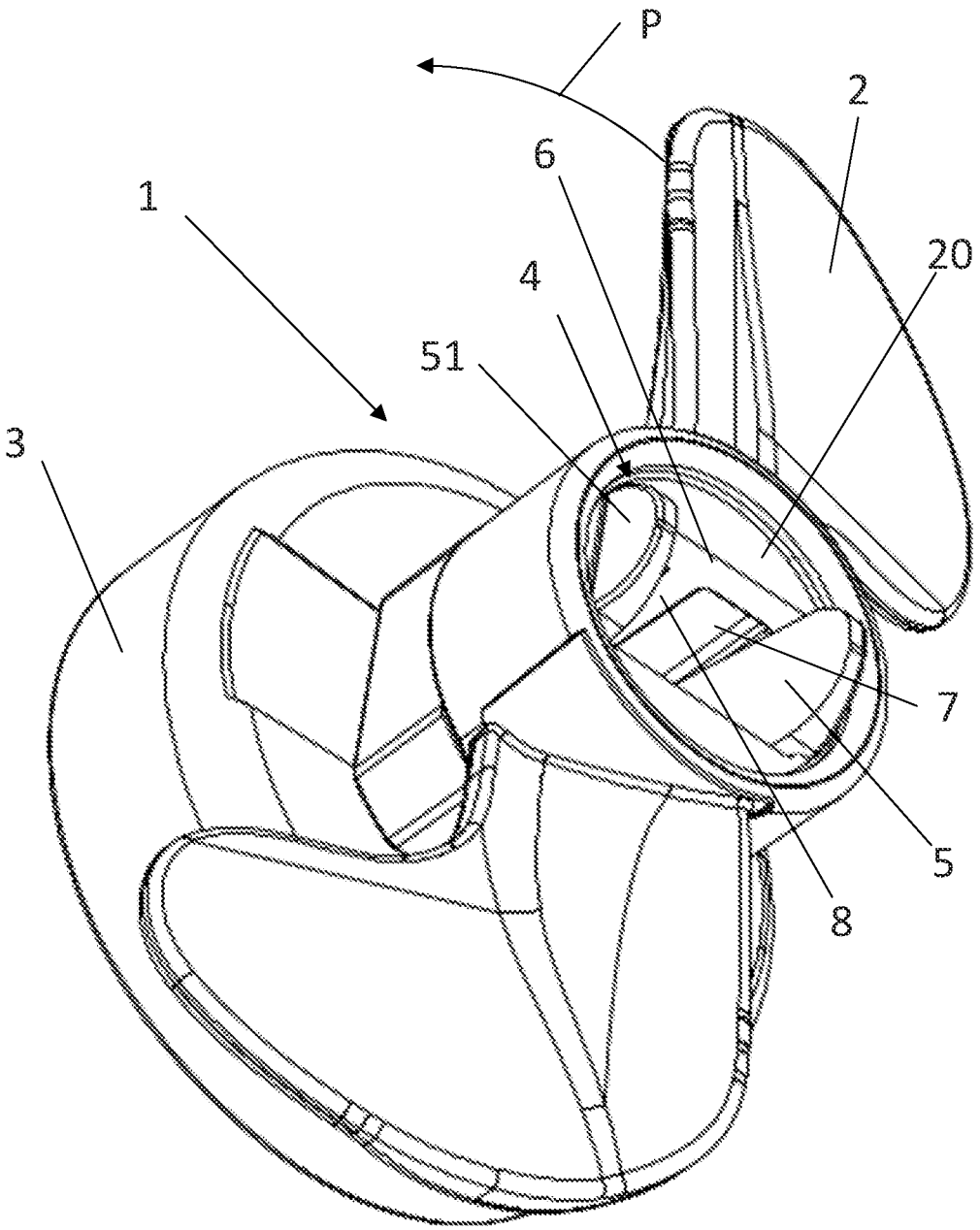
FIG. 1 shows a propeller arrangement according to the invention in an axonometric presentation.
Figure 2:
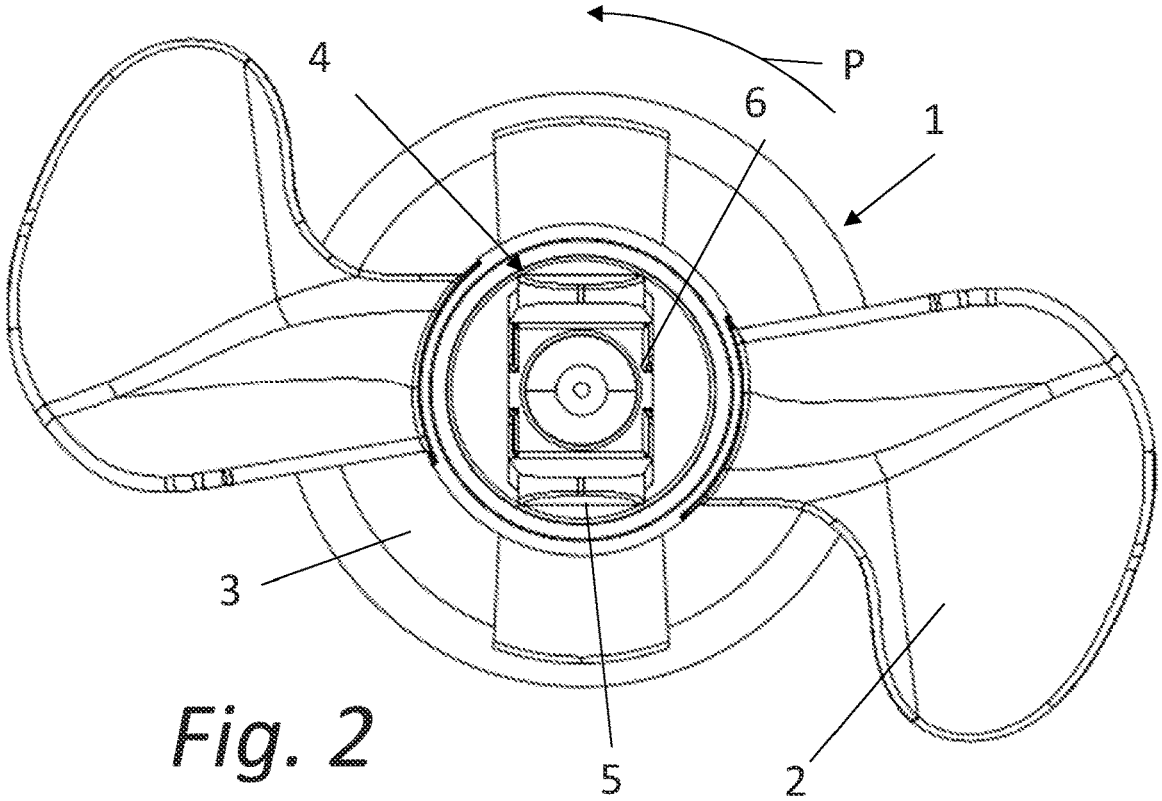
FIG. 2 shows the propeller arrangement in a plan view.
Figure 3:
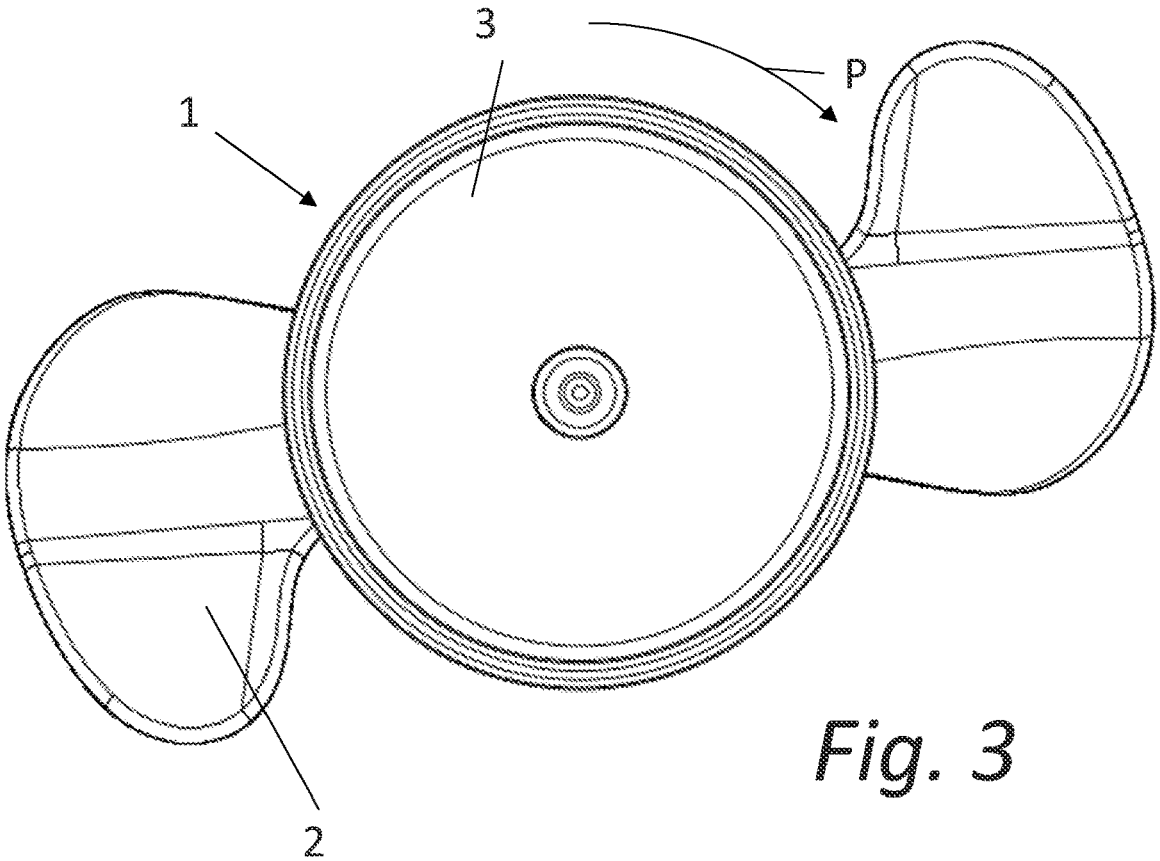
FIG. 3 shows the propeller arrangement in a bottom view.
Figure 4:
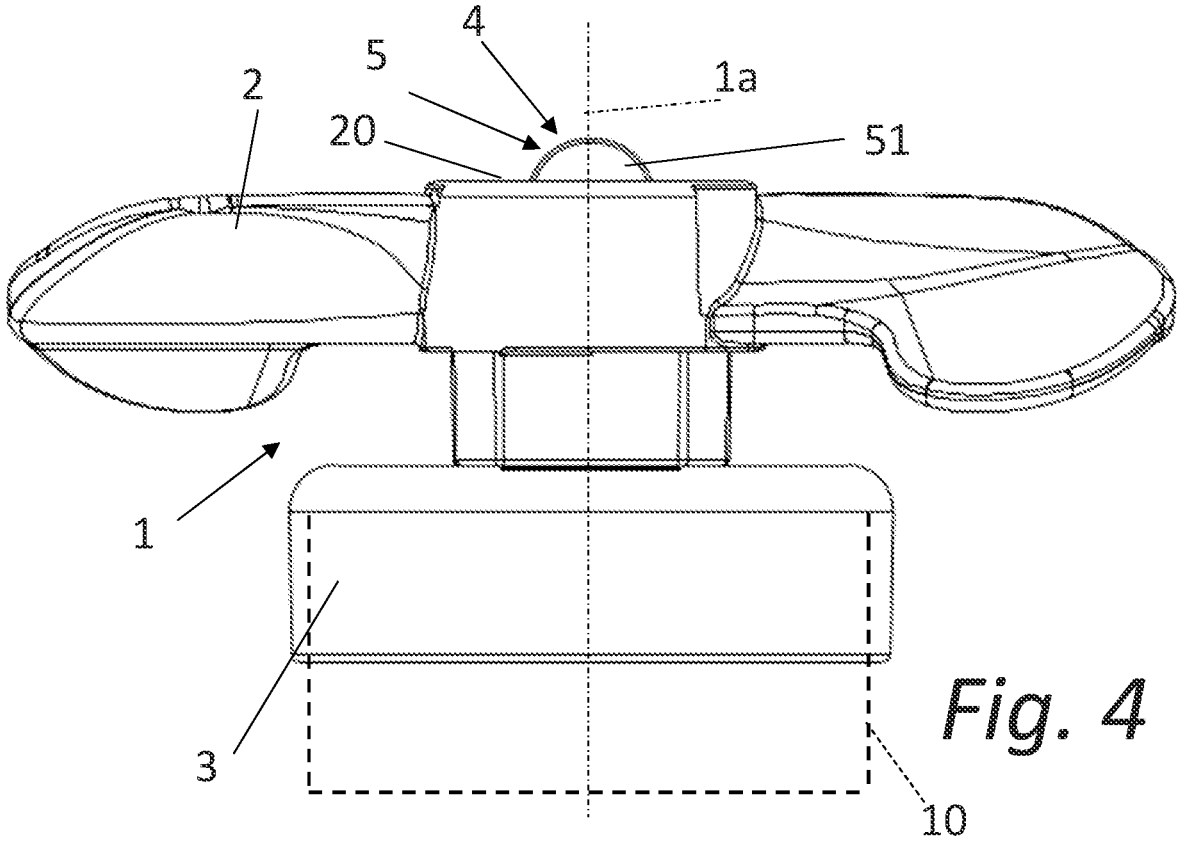
FIG. 4 shows the propeller arrangement in a side view.
Figure 5:
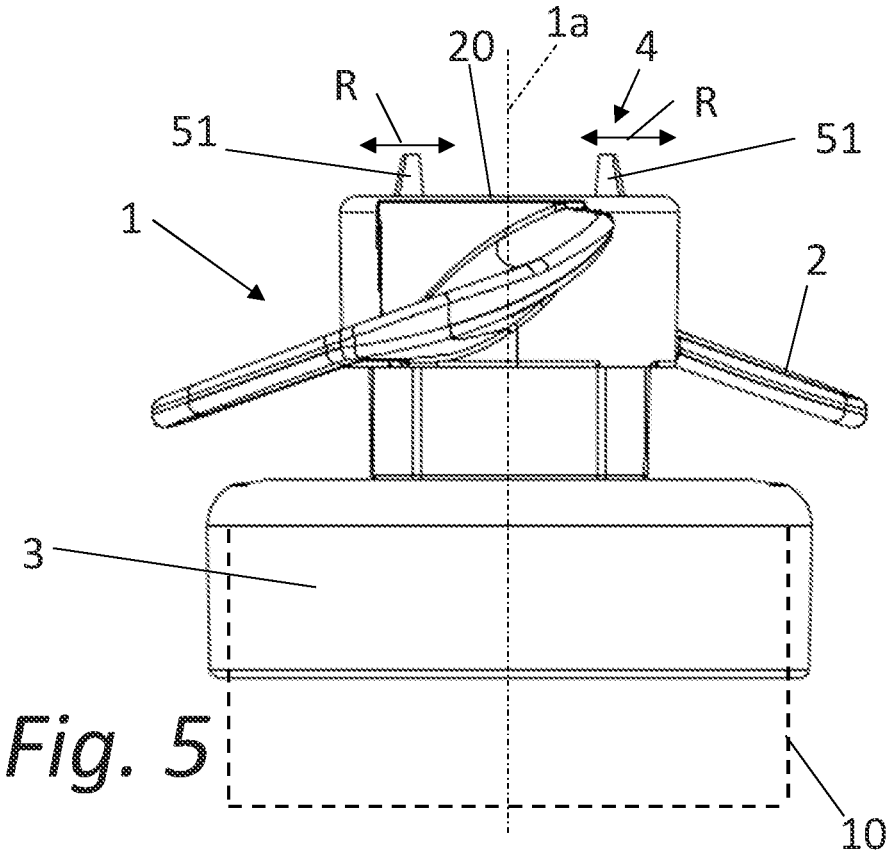
FIG. 5 shows the propeller arrangement in a further side view.

FIG. 1 to FIG. 5 show a propeller arrangement 1 having a propeller part 2 and a shaft part 3, for example for an underwater vacuum cleaner of a swimming pool. FIG. 6 to FIG. 10 show a propeller part 2 and FIG. 11 to FIG. 14 show a shaft part 3 of this propeller arrangement 1.

The propeller part 2 and the shaft part 3 are coaxially connected to each other via a latching connection 4. The shaft part 3 is designed, for example, as a shaft cap which can be connected or is connected in a rotationally fixed manner to a rotary shaft 10 of a drive motor not shown further, indicated by dashed lines in FIG. 4 and FIG. 5. The shaft cap can be permanently connected to the rotary shaft 10, for example, in particular pressed and/or glued or screwed. The propeller part 2 and/or the shaft part 3 may be made of a thermoplastic terpolymer, for example acrylonitrile-butadiene-styrene copolymer, The latching connection 4 has at least two latching fingers 5 that are elastically movable in a latching direction R radial to the axis of rotation 1*a* of the propeller arrangement 1—indicated by arrows in FIG. 5—and a latching opening 6 for accommodating the latching fingers 5. Latching hooks 51 are arranged at the ends of the latching fingers 5 (see FIG. 11 to FIG. 14). The latching fingers 5 are formed integrally with the shaft part 3. The latching hooks 51 engage behind the propeller part 2 at its free end face 20 facing away from the rotary shaft 10 and thus form a positive fit in the direction of the axis of rotation 1*a*. Furthermore, the size and shape of the latching fingers 5 and the latching opening 6 are matched so that together they form a positive connection in and against the direction of rotation P of the propeller arrangement 1, respectively. The positive connection is essentially defined by the cross-section of the latching opening 6 and the profile of the latching fingers 5.

Figure 6:
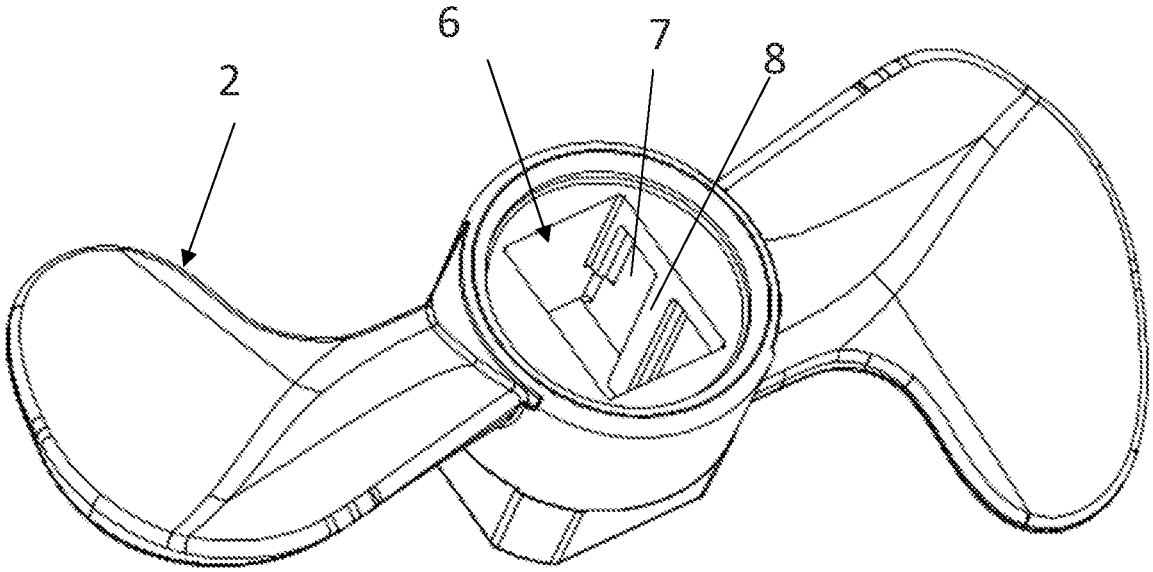
FIG. 6 shows a propeller part of the propeller arrangement in an axonometric representation.

In the exemplary embodiment shown, the latching opening 6 has a rectangular cross-section. In the assembled state, the latching fingers 5 are in direct contact with at least one first flank 61 of the latching opening 6. The first 61 and/or second flanks 62 of the latching opening 6 have at least one shaped portion or depression 7 and/or at least one guide strip 8 to allow easy assembly or disassembly (FIG. 6, FIG. 8).

Figure 7:
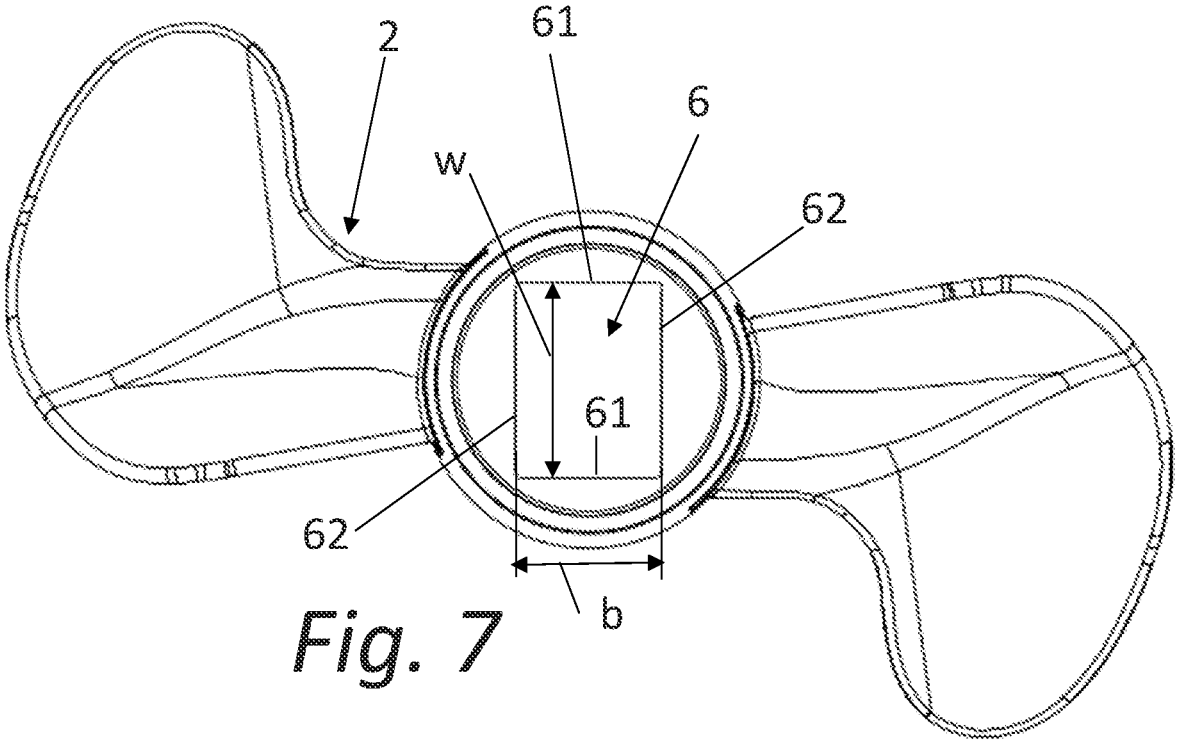
FIG. 7 shows the propeller part in a plan view.
Figure 8:
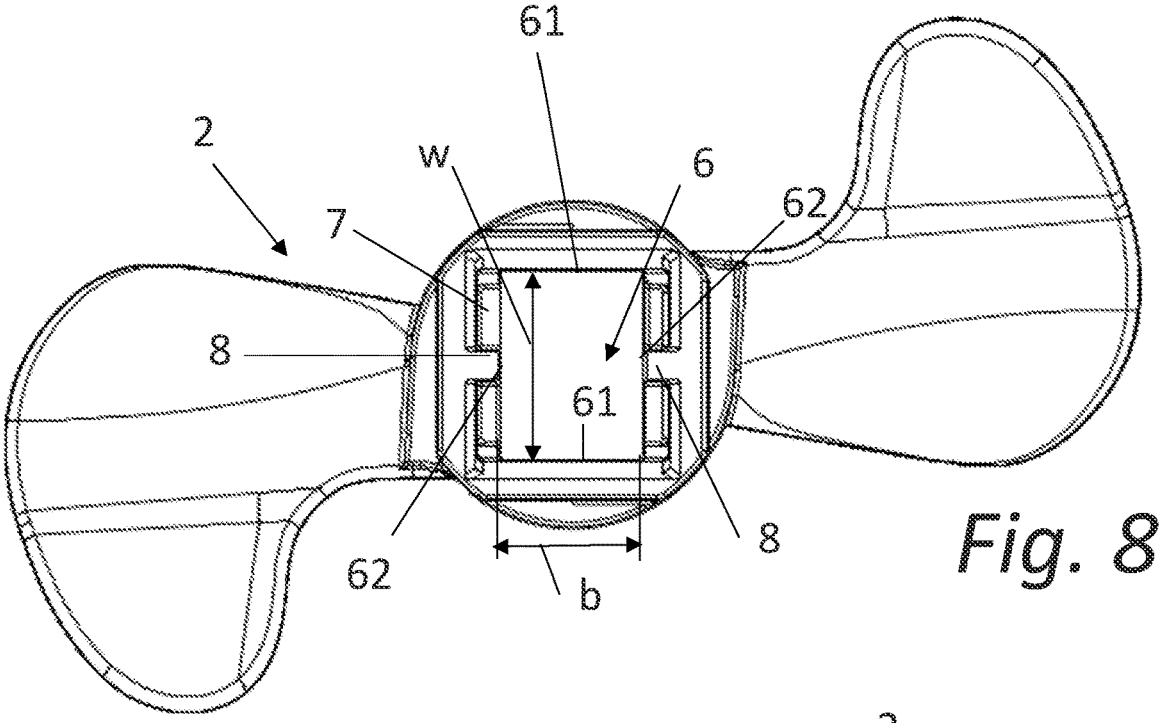
FIG. 8 shows the propeller part in a bottom view.
Figure 9:
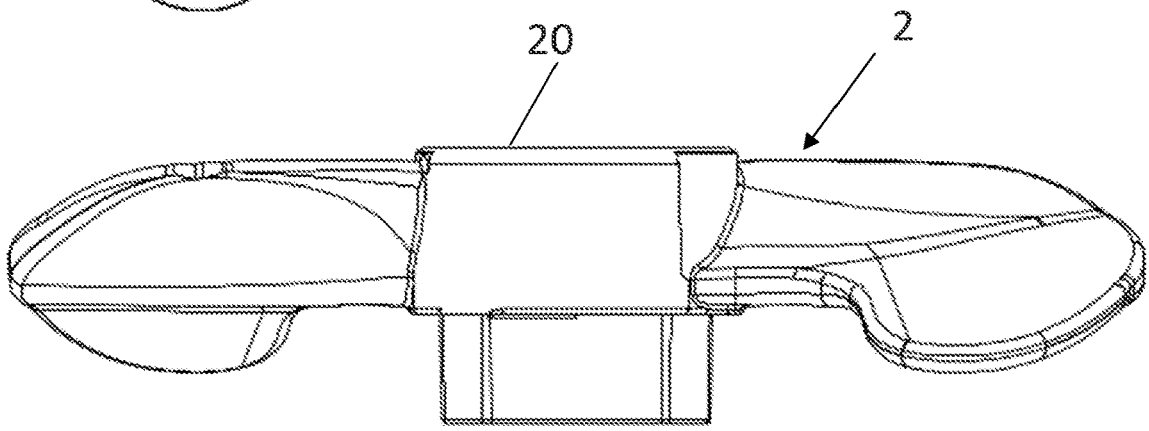
FIG. 9 shows the propeller part in a side view.
Figure 10:
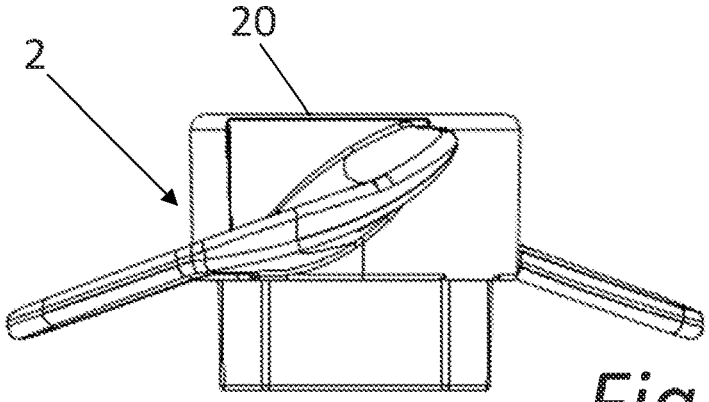
FIG. 10 the propeller part in a further side view.
Figure 11:
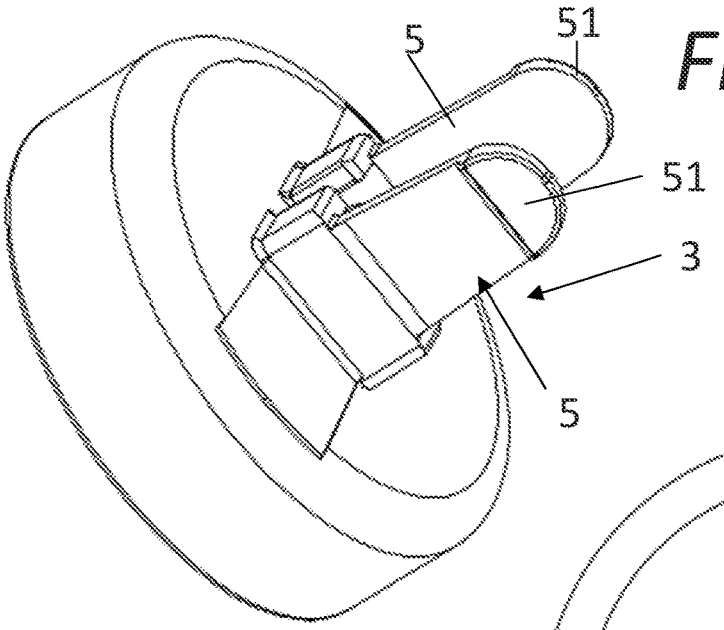
FIG. 11 shows a shaft part of the propeller arrangement in an axonometric view.
Figure 12:
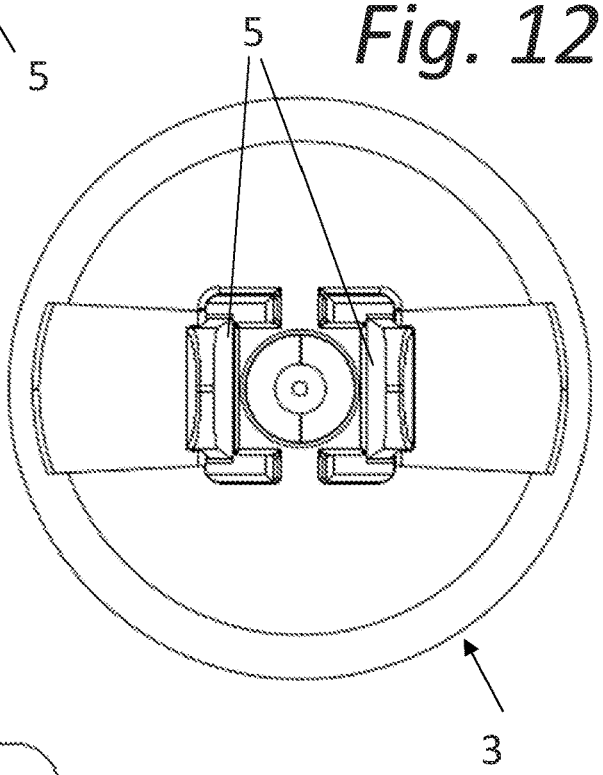
FIG. 12 shows a plan view of the shaft part.
Figure 13:
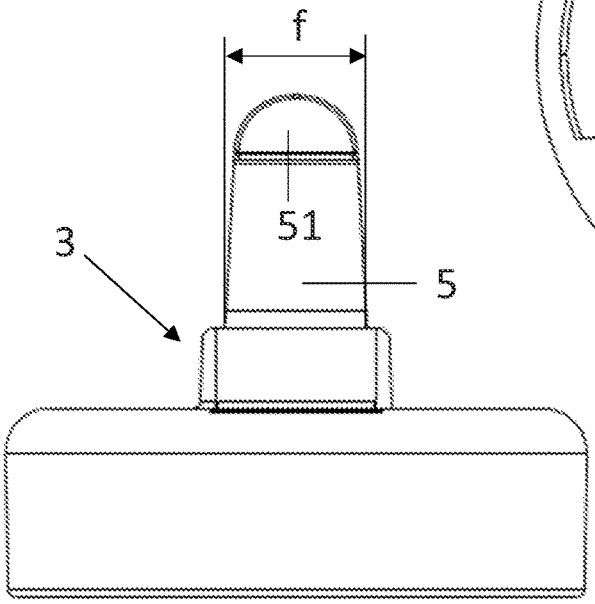
FIG. 13 shows the shaft part in a side view.
Figure 14:
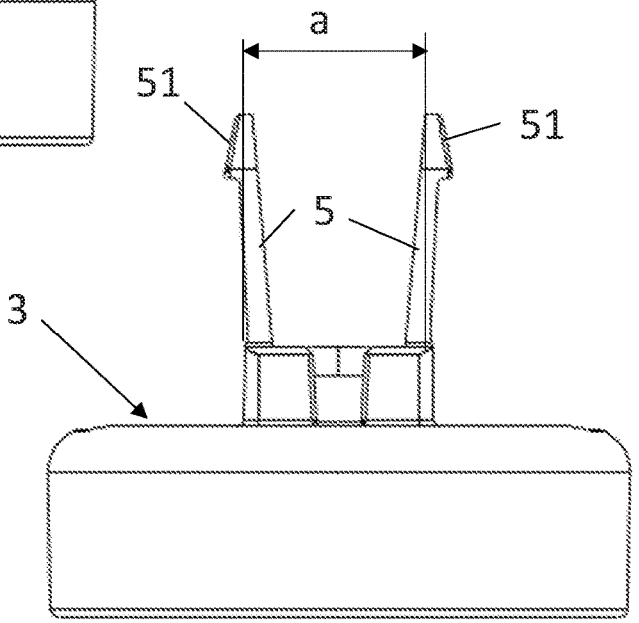
FIG. 14 shows the shaft part in a further side view.

As can be seen in FIG. 7 and FIG. 8, the latching opening 6 in the illustrated exemplary embodiment has a width b measured perpendicular to the latching direction R between two parallel first flanks 61 of the latching opening 6, which corresponds to at least one corresponding, e.g. maximum, finger width f of the latching fingers 5 (see FIG. 13). The finger width f and the width b of the latching opening 6 can be variable in the direction of the axis of rotation 1*a*. Furthermore, the latching opening 6 has a width w measured in latching direction R between two parallel second flanks 62, which corresponds at least to the minimum outer distance a of the latching fingers 5 from each other (see FIG. 14). This width w can also be constant in the direction of the axis of rotation 1*a* or change along the axis of rotation 1*a*.

The invention claimed is:

1. A propeller arrangement, comprising the following:

a propeller part and a shaft part, in particular for an underwater vacuum cleaner, wherein the propeller part and the shaft part are configured to be coaxially connected to one another via a latching connection, wherein the latching connection has at least two latching fingers, which can be moved elastically in a latching direction (R) radially with respect to an axis of rotation of the propeller arrangement, and a latching opening for accommodating the latching fingers, wherein the latching fingers are formed integrally with the shaft part, and the latching fingers and the latching opening form a positive connection, wherein the positive connection is defined by the cross-section of the latching opening and the profile of the latching fingers.

2. The propeller arrangement according to claim 1, wherein the latching opening has a rectangular cross-section.

3. The propeller arrangement according to claim 1, wherein the latching opening includes a first flank and a second flank and the latching fingers rest directly against the first flank or the second flank of the latching opening.

4. The propeller arrangement according to claim 3, wherein at least one flank of the latching opening has at least one depression or at least one guide strip.

5. The propeller arrangement according to claim 4, wherein the latching opening has a width (b) which is measured perpendicularly to the latching direction (R) between two parallel first flanks of the latching opening and corresponds to at least one finger width (f) of the latching fingers.

6. The propeller arrangement according to claim 1, wherein the latching opening has a width (w) which is measured in the direction of the latching direction (R) between two parallel second flanks and corresponds to at least a minimum outer distance (a) of the latching fingers from each other.

7. The propeller arrangement according to claim 1, wherein the shaft part is designed as a shaft cap.

8. The propeller arrangement according to claim 1, wherein the propeller part or the shaft part consists of a thermoplastic terpolymer, preferably an acrylonitrile-butadiene-styrene copolymer.

9. The propeller arrangement according to claim 1, wherein the latching fingers and the latching opening form the positive connection, in and against a direction of rotation (P) of the propeller arrangement.

10. The propeller arrangement according to claim 1, wherein the latching fingers and the latching opening form the positive connection, in or against a direction of rotation (P) of the propeller arrangement.

11. The propeller arrangement according to claim 1, wherein the latching opening includes a first flank and a second flank and the latching fingers rest directly against the first flank and the second flank of the latching opening.

12. The propeller arrangement according to claim 3, wherein at least one of the flanks of the latching opening has at least one depression and at least one guide strip.

13. The propeller arrangement according to claim 1, wherein the propeller part and the shaft part consist of a thermoplastic terpolymer, preferably an acrylonitrile-butadiene-styrene copolymer.

* * * * *